United States Patent [19]

Gosswiller

[11] Patent Number: 4,529,969

[45] Date of Patent: Jul. 16, 1985

[54] SIREN

[75] Inventor: Earl W. Gosswiller, Clarendon Hills, Ill.

[73] Assignee: Federal Signal Corporation, Oak Brook, Ill.

[21] Appl. No.: 446,517

[22] Filed: Dec. 3, 1982

[51] Int. Cl.[3] ..... G10K 7/00; G08B 3/06

[52] U.S. Cl. ..... 340/405; 116/147; 181/175

[58] Field of Search ..... D10/120; 116/147, DIG. 18, 116/DIG. 19; 181/0.5, 142, 143, 175, 191; 340/405; 367/151

[56] References Cited

U.S. PATENT DOCUMENTS

| | | | |
|---|---|---|---|
| 1,428,684 | 9/1922 | Erick | 116/147 |
| 2,015,387 | 9/1935 | Seiss | 116/147 |
| 2,869,667 | 1/1959 | Leslie | 181/143 |
| 3,982,142 | 9/1976 | Goble | 367/151 |
| 4,138,673 | 2/1979 | Faust | 340/405 |

*Primary Examiner*—Salvatore Cangialosi
*Assistant Examiner*—K. R. Kaiser
*Attorney, Agent, or Firm*—Charles F. Pigott, Jr.

[57] ABSTRACT

An improved siren including means for producing and directing sound energy against a rotatable reflector which directs the sound waves out from the siren in a generally horizontal direction and which due to rotation of the reflector about a vertical axis causes such sound waves to be directed in all horizontal directions. One embodiment includes rotor and stator means which create sound energy that is directed generally downwardly in the manner of a ring radiator, together with a reflector mounted beneath the rotor and stator for rotation about a generally vertical axis, the reflector being tilted relative to its axis of rotation to intercept the downwardly directed sound waves and direct them out horizontally thereby providing a directional siren which covers a 360 degree area due to rotation of the reflector.

14 Claims, 5 Drawing Figures

SIREN

BRIEF SUMMARY OF THE INVENTION

It is known to provide a non-directional siren where sound is emitted in all radial directions as opposed to a single limited radial direction. It is also known to provide a directional siren where sound is emitted in a limited radial direction. Such a directional siren has the power advantage of providing a concentration of energy in a limited radial direction, and such a directional siren may be rotated to direct sound in all radial directions.

Despite the foregoing advantage of directional sirens, they are relatively costly and complex due to the usual requirement that substantial mechanism be rotated about a generally vertical axis to produce sound in all radial directions.

It is an object of the present invention to provide a directional siren which is unusually simple in its construction and operation because the sound producing components are stationary while a single reflector member rotates for the purpose of emitting sound energy in all radial directions.

The foregoing and other objects and advantages of the invention will be apparent from the following description of a preferred embodiment, taken in conjunction with the accompanying drawings.

Now, in order to acquaint those skilled in the art with the manner of making and using my invention, I shall describe, in conjunction with the accompanying drawings, a preferred embodiment of the invention.

DETAILED DESCRIPTION OF THE INVENTION

Figure 1:
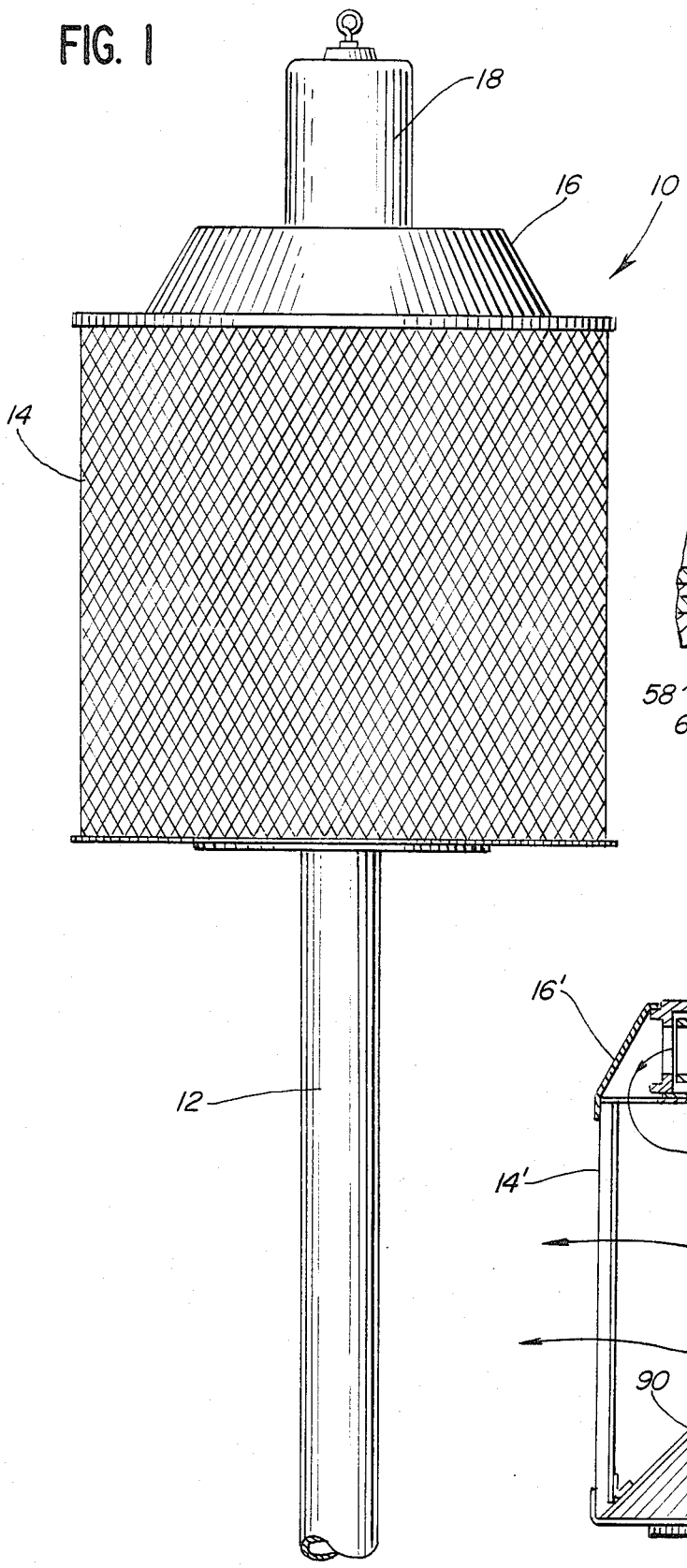
FIG. 1 is a vertical elevational view of a siren constructed in accordance with the present invention, the siren being mounted at the top of a utility pole.

Referring now to the drawings, FIG. 1 shows a siren 10 mounted at the upper end of a utility pole 12. By way of example only, the outer diameter of the siren screen 14 may be in the range of 3 to 4 feet, and the siren may be mounted 50 feet above ground level. The siren 10 includes an upright cylindrical screen 14 which surrounds the siren components and serves the purpose of keeping birds, snow, dirt and other foreign matter out of the siren mechanism. It will be understood that because the siren is vertical or upright, it is self-draining. FIG. 1 further shows a cover 16, and a motor 18 mounted at the upper end of the siren assembly.

Figure 3:
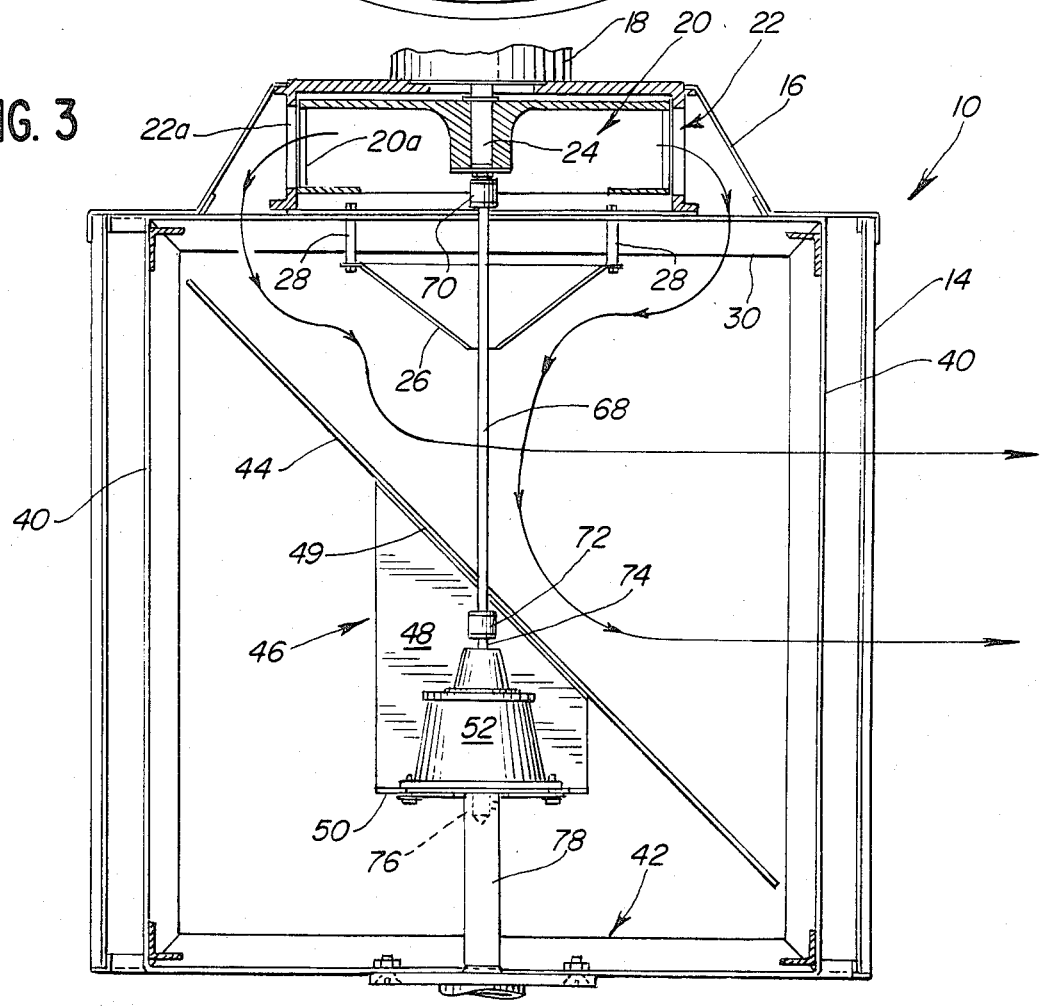
FIG. 3 is a vertical sectional view taken substantially along the line 3—3 of FIG. 2.

FIG. 3 shows sound producing apparatus mounted on a frame at the top of the siren 10 beneath the motor 18 for producing sound energy which is directed radially outwardly and then downwardly by means to be described later herein. The sound producing apparatus includes a rotor 20 and stator 22 which are per se known in the art. The stator 22 is a fixed, upright, cylindrical member having a plurality of ports of openings 22*a*. The rotor 20 is a cylindrical member mounted inside the stator and having a plurality of openings 20*a* in a cylindrical flange. Rotor 20 is mounted on a motor drive shaft 24 for rotating the rotor at high speed which in the preferred embodiment is approximately 3400 rpm.

When rotor 20 is rotated at high speed within stator 22, the openings 20*a* in the outer circumferential flange of the rotor serve to open and close the ports 22*a* in the circumferential wall of the stator. Such rotation of rotor 20 causes air to be drawn up from the area beneath the rotor, and such air is drawn into the rotor and then forced outwardly through the openings 22*a* in the stator to produce the desired sound energy which due to cover 16 is directed downwardly.

Still referring to FIG. 3, there is further provided a conically shaped tuning deflector 26 which is fixedly suspended beneath rotor 20 by a plurality of vertical rods 28. It has been found the deflector plate 26 aids in the effective production of downwardly directed sound energy from the annular area defined between the outside of the stator 22 and the inside of cover 16. The sound-producing components described above function in the manner of a ring radiator to produce a circle or ring of downwardly directed sound energy from an annular area inside cover 16 as shown by the arrows in FIG. 3. It is believed that the deflector plate 26 serves to create a condition where the sound waves or back waves emanating from inside the rotator and the sound waves or front waves emanating from outside of the stator are in phase and thus constructive to each other.

Figure 2:
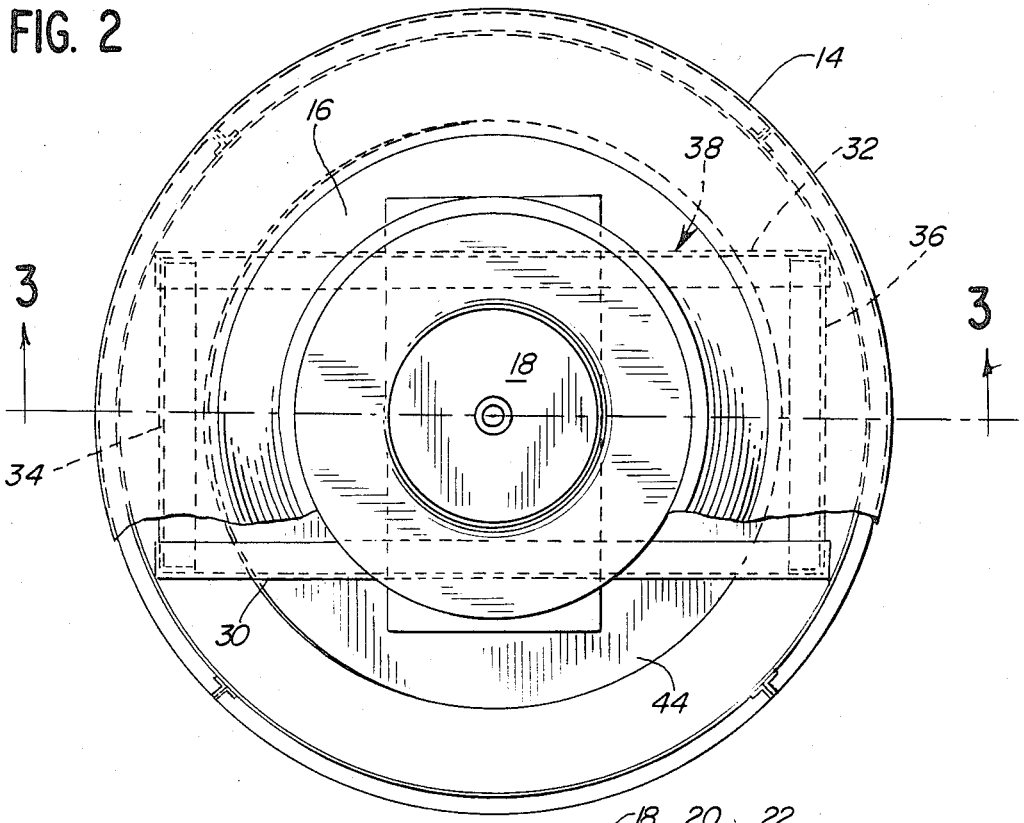
FIG. 2 is an enlarged top plan view of the siren of FIG. 1, certain components being partly broken away to illustrate a rotatable reflector.

The structure of siren assembly 10 includes a frame including a top portion which as shown in dash lines in FIG. 2 comprise parallel front and back frame members 30 and 32, and a pair of side frame members 34 and 36, the foregoing structural members being connected to provide an upper rectangular frame 38 which is connected at its four corners by vertical beams 40 to a similar lower frame 42. In the foregoing manner, a mounting or frame assembly is formed for supporting the sound producing and other elements of the siren assembly including the cylindrical screen 14.

An important feature of the present invention comprises the use of a reflector 44 to reflect the sound energy from the ring radiator outwardly in a generally horizontal direction. Rotor 20, stator 22, cover 16 and deflector plate 26 function in combination as a ring radiator to produce a ring of downwardly directed sound energy, and reflector 44 deflects that energy outwardly through screen 14 is a generally horizontal or radial direction. In the preferred embodiment being described, reflector 44 is a flat aluminum plate approximately 36 inches in its major dimension. The reflector plate 44 is generally elliptical in shape, but with slightly flattened ends. The foregoing plate is tilted at 45 degrees to the vertical for the purpose of deflecting the downwardly directed sound energy outwardly along an approximately horizontal path.

Figure 4:
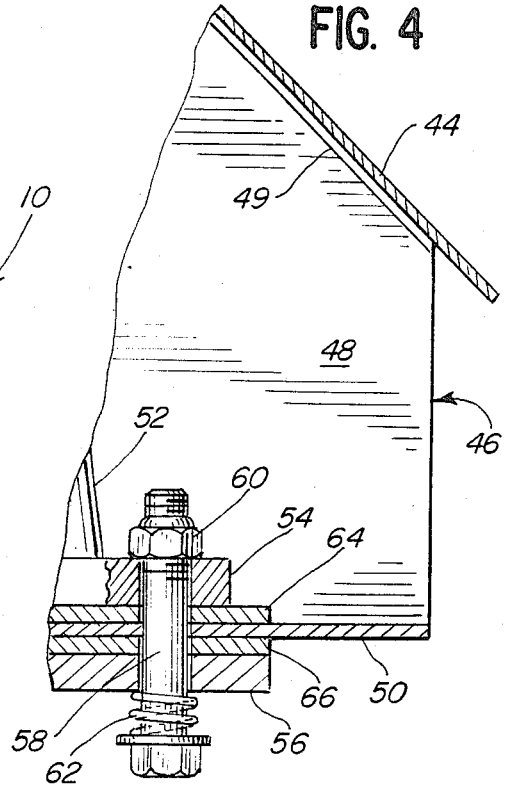
FIG. 4 is an enlarged, fragmentary vertical sectional view showing the manner of mounting a rotatable reflector member to afford frictional drive of the reflector.

The reflector plate 44 includes a mounting bracket 46 including a plate 48 bent at its upper end 49 and secured to the underside of the reflector as shown in FIG. 3, and bent at its lower end 50 to form a bracket base. The bracket base 50 has a large central opening and thus comprises an inwardly directed circumferential rim which is driven to rotate reflector 44. As shown in FIGS. 3 and 4, bracket rim 50 is mounted by frictional drive means to the lower end of a rotatable gear reducer 52.

As best shown in FIG. 4, bracket rim 50 is frictionally clamped between a circumferential bottom rim 54 of gear reducer 52 and a pressure plate 56, such clamping being achieved by a vertical bolt 58, nut 60, and compression spring 62 mounted between the head of the bolt and the pressure plate 56 thereby biasing plate 56 toward the gear reducer rim 54. A pair of friction pads 64 and 66 are mounted on opposite sides of the bracket rim 50 to control slippage between the reflector plate 44 and the gear reducer 52, as will be described more fully hereinbelow.

In the preferred embodiment being described, reflector 44 is driven from drive motor 18 through a drive shaft 68 which is coupled to motor shaft 24 by a coupling 70. The lower end of drive shaft 68 is coupled at 72 to the input 74 of gear reducer 52. An output shaft 76 of the gear reducer is fixedly mounted in the upper end of a fixed post 78. Because the output shaft 76 of the gear reducer 52 is fixed, the gear reducer body 52 will itself rotate and thereby rotate reflector 44 through the above-described friction drive connection with reflector bracket rim 50. It is desirable that the reflector 44 be rotated at a low speed such as 2 rpm.

The operation of the above-described directional siren 10 will now be described. Operation of drive motor 18 causes rotor 20 to rotate within stator 22 at a speed of 3400 rpm, and drive shaft 68 operates through gear reducer 52 to rotate reflector 44 at 2 rpm. Rotation of rotor 20 causes air to be drawn up into the rotor and forced out through the ports **22*a* of stator 22, thereby producing sound energy. The air and sound is controlled in part by cover 16 and deflector 26 causing a downwardly directed ring of sound energy flowing from the annular area between the bottom of cover 16 and the outside of stator 22, as shown generally by the arrows in FIG. 3. Such sound energy impinges against the reflector 44 which deflects it in a generally radial or horizontal direction in the manner of a directional siren. As reflector 44** rotates through 360 degrees, such sound energy is emitted in all radial directions.

The foregoing directional siren has many important advantages over directional sirens which require additional components such as horns to be rotated to direct sound energy in all radial directions. In accordance with the present design, the principal rotating component is reflector 44. Moreover, it will be understood that in accordance with the present invention, other alternative means may be utilized for producing sound energy rather than rotor 20 and stator 22. For example, it would be feasible to provide one or more downwardly directed stationary electronic horns to produce sound energy which is reflected out in horizontal directions by the rotatable reflector. It will further be understood that the unit could be inverted, and sound energy directed upwardly to impinge against a reflector positioned above the source of sound energy.

In the preferred embodiment described above, drive motor 18 for rotor 20 is also used to supply power for rotation of reflector 44. If desired, a separate drive motor may be provided for the reflector. However, it is preferred to use a friction type drive for the reflector as described above, because in the event the reflector is blocked from rotation, the friction drive will permit slippage thereby avoiding damage to the mechanism.

Figure 5:
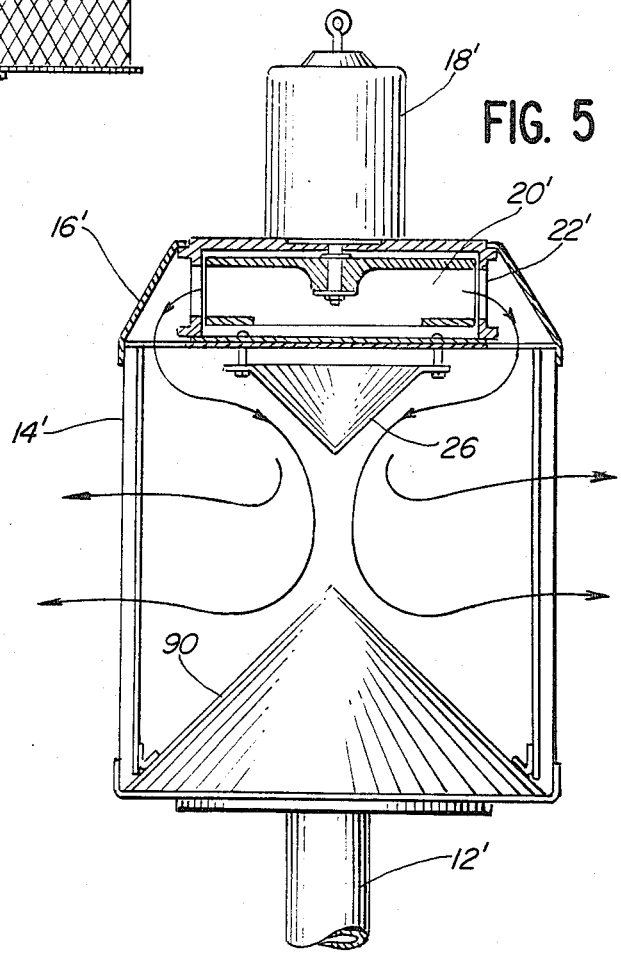
FIG. 5 is a vertical sectional view of an alternative embodiment of the invention comprising a non-directional siren utilizing a stationary reflector.

FIG. 5 illustrates an alternative embodiment of the invention in which the several components which correspond with the components of the embodiment of FIGS. 1–4 are described with corresponding primed reference numerals. The principal modification in the embodiment of FIG. 5 is that the reflector 44 and associated drive mechanism has been removed and replaced by a stationary reflector 90 which is conically shaped and defines a 45 degree angle with its vertical axis. It will thus be understood that downwardly directed sound energy produced by rotor 20' and stator 22' will be deflected in all horizontal directions by the stationary reflector 90. Accordingly, the modified siren shown in FIG. 5 is a non-directional siren.

What is claimed is:

1. A directional siren of the type which without rotation of said siren emits sound in a limited generally horizontal direction and includes rotating means to sweep through a circle to emit such sound in substantially all radial directions, the improvement comprising, in combination, sound producing means for producing sound energy and directing said energy in a direction at a substantial angle to the horizontal, reflector means positioned to intercept said sound energy and reflect the same in a limited generally horizontal direction, drive means for rotating said reflector means about a generally vertical axis for emitting sound energy in substantially all radial directions, and conically-shaped tuning deflector means positioned between the sound producing means and the reflector means and pointing away from said sound producing means and toward the reflector means, whereby sound wave reinforcement takes place.

2. A directional siren of the type defined in claim 1 where said sound producing means directs said sound energy in a generally vertical direction so it impinges on said reflector means and is reflected in a generally horizontal direction.

3. A directional siren of the type defined in claim 2 where said sound producing means functions as a ring radiator to produce an approximate ring of generally vertically directed sound energy.

4. A directional siren of the type defined in claim 1 where said reflector means comprises a generally flat plate which is rotatable about a generally vertical axis.

5. A directional siren of the type defined in claim 1 where said sound producing means comprises a rotor mounted for rotation about a generally vertical axis, a stator surrounding said rotor, and motor means for driving said rotor.

6. A directional siren of the type defined in claim 5 where said drive means for rotating said reflector means is driven from said motor means through gear reducer means.

7. A directional siren of the type defined in claim 1 where said drive means comprises frictional drive means which permits slippage in the event said reflector means blocked from rotation.

8. A directional siren of the type defined in claim 1 including upright cylindrical screen means surrounding said reflector means to protect the same against foreign matter.

9. A directional siren of the type which without rotation of said siren emits sound in a limited generally horizontal direction and includes rotating means to sweep through a circle to emit such sound in substantially all radial directions, the improvement comprising, in combination, sound producing means for producing sound energy and directing said energy in a generally vertical direction, reflector means tilted between the vertical and horizontal and positioned to intercept said sound energy and reflect the same in a limited generally horizontal direction, drive means for rotating said reflector means about a generally vertical axis for emitting sound energy in substantially all radial directions, and conically-shaped tuning deflector means positioned between the sound producing means and the reflector means and pointing away from said sound producing means and toward the reflector means, whereby sound wave reinforcement takes place.

10. A directional siren of the type defined in claim 9 where said reflector means comprises a generally flat plate tilted approximately 45 degrees to the vertical.

11. A directional siren of the type defined in claim 9 where said sound producing means is mounted adjacent the upper end of said siren to produce generally downwardly directed sound energy, and said reflector means is mounted beneath said sound producing means to intercept said energy and reflect said energy generally horizontally.

12. A directional siren of the type defined in claim 9 where said sound producing means is mounted adjacent the upper end of said siren to produce generally downwardly directed sound energy, and said reflector means comprises a generally flat plate mounted beneath said sound producing means and tilted approximately 45 degrees to the vertical.

13. A directional siren of the type which without rotation of said siren emits sound in a limited generally horizontal direction and includes rotating means to sweep through a circle to emit such sound in substantially all radial directions, the improvement comprising, in combination, sound producing means for producing sound energy and directing said energy in a generally vertical direction, said sound producing means being arranged to function as a ring radiator and provide an approximate ring of generally vertically directed sound energy, reflector means tilted approximately 45 degrees to the vertical and positioned to intercept said sound energy and reflect the same in a limited generally horizontal direction, drive means for rotating said reflector means about a generally vertical axis for emitting said sound energy in substantially all radial directions, and conically-shaped tuning deflector means positioned between the sound producing means and the reflector means and pointing away from said sound producing means and toward the reflector means, whereby sound wave reinforcement takes place.

14. A directional siren of the type defined in claim 13 where said sound producing means includes a rotor mounted for rotation about a generally vertical axis, a stator surrounding, said rotor, motor means for driving said rotor, and conically-shaped turning deflector means mounted between said rotor and said reflector means to assist in producing a ring of sound energy directed generally vertically toward said reflector means.

* * * * *